United States Patent [19]

Boyadjieff

[11] Patent Number: 4,458,768

[45] Date of Patent: Jul. 10, 1984

[54] TOP DRIVE WELL DRILLING APPARATUS

[75] Inventor: George I. Boyadjieff, Anaheim, Calif.

[73] Assignee: Varco International, Inc., Orange, Calif.

[21] Appl. No.: 404,638

[22] Filed: Aug. 2, 1982

Related U.S. Application Data

[62] Division of Ser. No. 227,587, Jan. 23, 1981, Pat. No. 4,421,179.

[51] Int. Cl.[3] ..... E21B 19/00

[52] U.S. Cl. ..... 175/85; 173/43

[58] Field of Search ..... 173/39, 42, 43, 44, 173/147, 149; 175/52, 85

[56] References Cited

U.S. PATENT DOCUMENTS

| | | | |
|---|---|---|---|
| 1,377,575 | 5/1921 | Greve . | |
| 2,792,198 | 5/1957 | Braun . | |
| 2,960,311 | 11/1960 | Scott . | |
| 2,998,084 | 8/1961 | Johnson et al. . | |
| 3,009,521 | 11/1961 | Failing . | |
| 3,053,330 | 9/1962 | Arthur . | |
| 3,126,063 | 3/1964 | Pitt et al. . | |
| 3,451,493 | 6/1969 | Storm . | |
| 3,539,024 | 11/1970 | Irons et al. | 175/85 |
| 3,650,339 | 3/1972 | Selfe et al. | 175/85 |
| 3,664,439 | 5/1972 | Council | 175/52 |
| 3,708,024 | 1/1973 | Back | 175/52 |
| 3,835,940 | 9/1974 | Winter, Jr. | 175/85 |
| 3,913,753 | 10/1975 | Swartz et al. | 175/85 |
| 3,961,673 | 6/1976 | Wolters et al. | 175/85 |
| 4,195,698 | 4/1980 | Nakagawasai | 173/44 |
| 4,262,754 | 4/1981 | Nelson | 173/43 |
| 4,348,920 | 9/1982 | Boyadjieff | 175/85 |
| 4,371,041 | 2/1983 | Becker et al. | 175/85 |

FOREIGN PATENT DOCUMENTS

| | | | |
|---|---|---|---|
| 7006968 | 11/1970 | Netherlands | 175/85 |
| 2063333 | 6/1981 | United Kingdom | 175/85 |

OTHER PUBLICATIONS

"Descriptive Data-Bowen ES-7 Electric Drilling Swivel and Accessories."

*Primary Examiner*—Stephen J. Novosad
*Assistant Examiner*—William P. Neuder
*Attorney, Agent, or Firm*—William P. Green

[57] ABSTRACT

Well drilling apparatus including a powered drilling unit connectable to the upper end of a drill string and adapted to rotate it to drill a well, and a vertically extending guide track structure which guides the drilling unit for movement along the axis of the well, with a portion of the guide track structure being mounted for swinging movement between a drilling position in which the drilling unit is aligned with the axis of the well and a slightly inclined position in which the track structure guides the drilling unit for movement along an inclined axis in alignment with a mousehole, and with the drilling unit also preferably being mounted for movement to a laterally retracted position at a side of the well in which it leaves an area along the axis of the well unobstructed for use of conventional hoisting equipment in making a 'round trip' of the drill string out of and then back into the well.

9 Claims, 11 Drawing Figures

FIG. 3
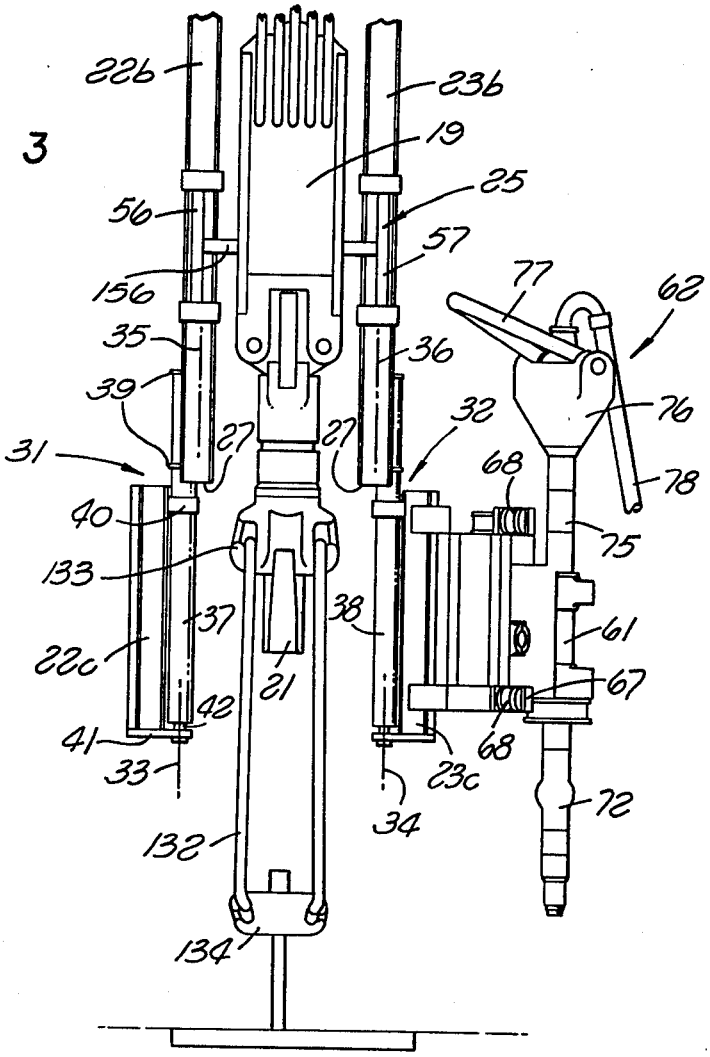
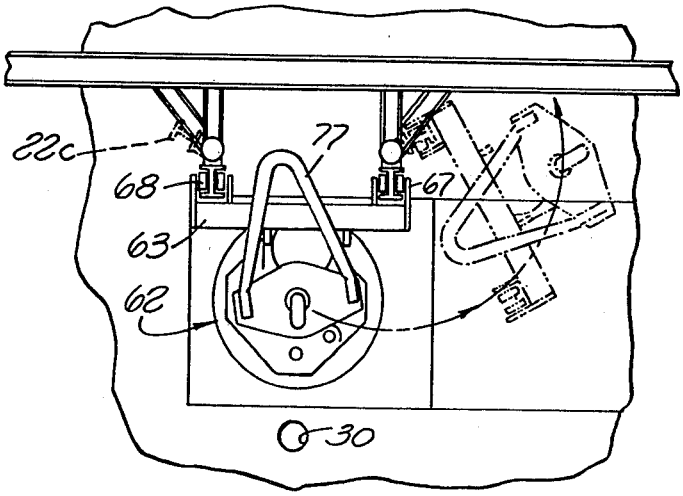
FIG. 4

TOP DRIVE WELL DRILLING APPARATUS

This application is a division of application Ser. No. 6/227,587, filed 1/23/81, now U.S. Pat. No. 4,421,179.

BACKGROUND OF THE INVENTION

This invention relates to improved well drilling apparatus adapted to drive a drill string without the use of a rotary table, kelly, and kelly bushing.

In order to avoid the necessity for a rotary table and its related equipment in a well drilling rig, there have been devised in the past arrangements employing a drilling unit having a pipe section connectable to the upper end of a drill string and a motor for driving that pipe section rotatively and thereby driving the string to perform a drilling operation. In some instances, the drilling unit has been mounted on a carriage which is guided by vertical tracks for movement along those tracks axially of the well to advance with the string as the drilling operation progresses. In one prior arrangement of this type, the drilling unit is connected pivotally to the carriage to swing relative to the carriage and tracks to an inclined position of alignment with a mousehole in order to pick up a pipe section from or place it into the mousehole. Copending application Ser. No. 167,758 filed July 14, 1980 by Boyadjieff et al. on "Well Drilling Apparatus" shows a system in which the drilling unit is bodily shiftable horizontally between a drilling position of alignment with the well axis and a position of vertical alignment with a mousehole, and also is mounted for horizontal swinging movement relative to the main portion of the track structure to a laterally retracted position at a side of the well.

SUMMARY OF THE INVENTION

The present invention provides an improved drilling system of the above discussed general type, in which the drilling unit is movable from a drilling position of alignment with the well axis to a mousehole position, and preferably also to a retracted position at a side of the well permitting a 'trip' of the drill string into or out of the well by other equipment, and which is so constructed as to afford a very rugged and effective support for the drilling unit in all of these various positions. Further, the apparatus acts to positively guide the drilling unit for movement along predetermined controlled paths in both the drilling position of the unit and its mousehole position, and to power actuate the unit between those two positions. In addition, all of these results are achieved with apparatus which is extremely simple structurally and therefore inexpensive to manufacture and maintain and capable of functioning over long periods of time without operational difficulties.

A major feature of the present invention resides in the unique way that a drilling unit embodying the invention is mounted for movement between its drilling and mousehole positions. This movement is accomplished by mounting at least part of the elongated guide or track structure for slight pivotal movement between a drilling position in which the guide structure mounts the drilling unit for movement along the verical axis of the drill string and an inclined position in which the guide structure is disposed at a slight angle to the axis of the drill string and is inclined in alignment with a mousehole. The powered drilling unit, including a pipe section connectable to the drill string and a motor for driving that pipe section, swings with the guide or track structure between its discussed drilling and mousehole positions, and is guided by the guide structure for movement therealong in both of those positions. Preferably, the guide structure is movable by a power unit between its drilling and mousehole positions, and has latch means for releasably retaining the entire structure in the drilling position.

In addition to its swinging movement with the track structure, the drilling unit is preferably also mounted for movement laterally or generally horizontally relative to the major portion of the track structure between the drilling position and a laterally offset retracted position away from the axis of the drill string, to permit a trip of the string into or out of the hole by the usual traveling block and related equipment. The lower portion of the guide track structure may be constructed to allow for such lateral shifting movement of the drilling unit to a retracted position when the drilling unit is in a lowermost position on the guide structure. Desirably, one of two guide rails has a lower portion which is mounted for pivotal movement in a manner swinging the guide unit when connected to that lower rail portion to its retracted position.

Additional features of the invention relate to a preferred structure for the drilling unit, in which the tubular driven shaft of the unit, which is connected to and drives the drill string, is mounted rotatably at a side of the case of the drilling unit motor, by bearings which are secured to the motor case at spaced locations near the opposite ends of the motor armature.

BRIEF DESCRIPTION OF THE DRAWINGS

The above and other features and objects of the invention will be better understood from the following detailed description of the typical embodiments illustrated in the accompanying drawings, in which:

FIG. 3 is a fragmentary front elevational view showing the drilling unit swung to its retracted position permitting a trip of the well pipe into or out of the well;

FIG. 4 is an enlarged fragmentary plan view taken on line 4—4 of FIG. 1;

DESCRIPTION OF THE PREFERRED EMBODIMENTS

Figure 1:
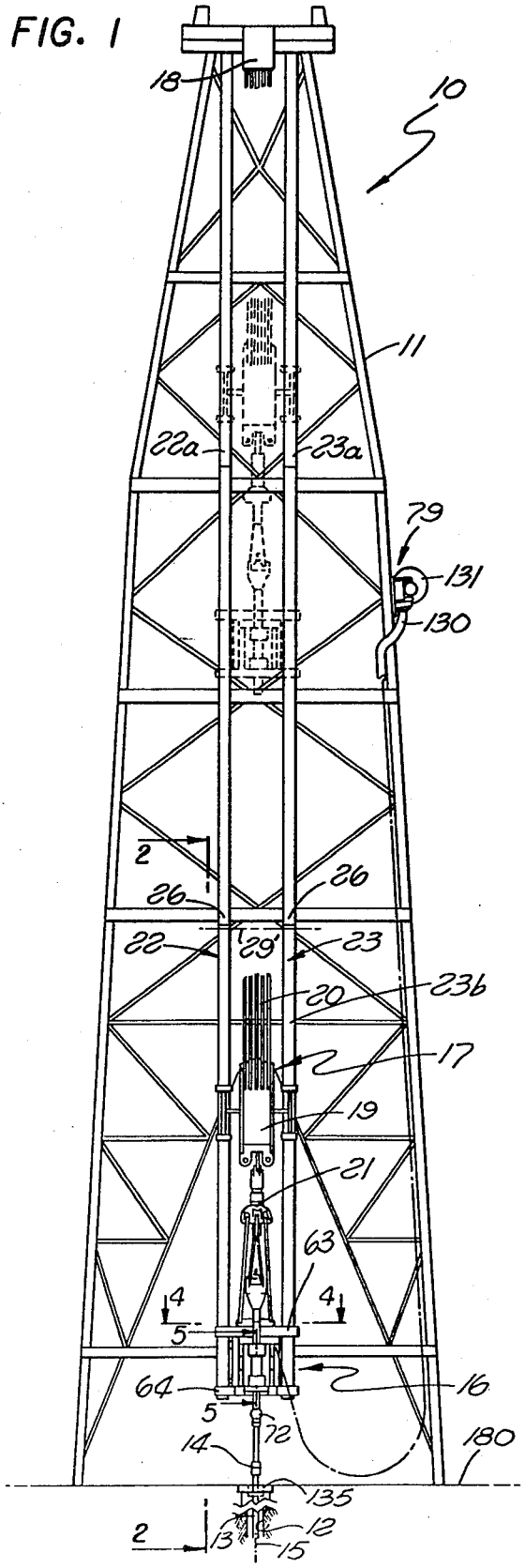
FIG. 1 is a front elevational view of well drilling apparatus embodying the present invention.

The drilling rig 10 illustrated in FIG. 1 includes a derrick 11 projecting upwardly above a location at which a well bore 12 is being drilled by a rotary drill string 13 formed in conventional manner in a series of drill pipe stands connected together in end-to-end fashion at threaded connections 14. The string 13 is turned about the vertical axis 15 of the well by a drilling unit 16 formed in accordance with the invention and connected to the upper end of the string. The drill string and unit 16 are supported and adapted to be moved upwardly and downwardly by the usual hoisting mechanism 17 including a crown block 18, traveling block 19, tackle 20 supporting block 19 from block 18, and power driven draw works for reeling the line 20 in or out to raise or lower the traveling block. The traveling block supports a hook 21 from which the drilling unit is suspended, and which has a gate 121 adapted to be opened for connecting and disconnecting the drilling unit. The drilling unit 16 and hook 19 are guided during their upward and downward movement by two sectionally formed parallel elongated guide rails 22 and 23, engaging and guiding a carriage 24 forming a portion of the drilling unit and a carriage 25 to which the traveling block is connected.

Figure 10:
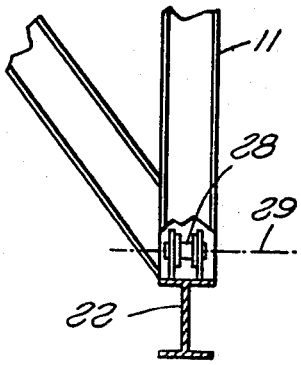
FIG. 10 is an enlarged fragmentary horizontal section taken on line 10—10 of FIG. 2.

The two sectionally formed guide rails 22 and 23 are preferably of H-shaped horizontal sectional configuration as illustrated in FIGS. 4 and 10. This H-shaped cross section continues from the upper extremity of each rail to its lower extremity. The rails 22 and 23 have upper sections **22*a* and 23*a*, which extend from the upper end of derrick 11 to the locations 26 of FIG. 1, and are attached rigidly to the derrick for retention stationarily in positions of extension directly vertically and parallel to one another and to well axis 15. Beneath the locations 26, the two guide rails 22 and 23 have second portions or sections 22*b* and 23*b*, extending parallel to one another and continuing downwardly from the locations 26 to locations 27 of FIG. 3. These sections 22*b* and 23*b* are mounted by two pivotal connections 28 for swinging movement relative to upper sections 22*a* and 23*a* and about a horizontal axis 29' between the full line and broken line positions of FIG. 2. In the broken line positions of FIG. 2, rail sections 22*b* and 23*b* are disposed directly vertically and directly parallel to well axis 15 and are in vertical alignment with upper sections 22*a* and 23*a* respectively to form vertical continuations thereof. In the full line position of FIG. 2, sections 22*b* and 23*b* remain parallel to one another but are inclined at a slight angle a with respect to the vertical and with respect to the longitudinal axes of upper rail sections 22*a* and 23*a*, to bring the axis 29 of the drilling unit in alignment with an inclined mousehole 30 located a short distance forwardly of the main axis 15** of the well.

Figure 2:
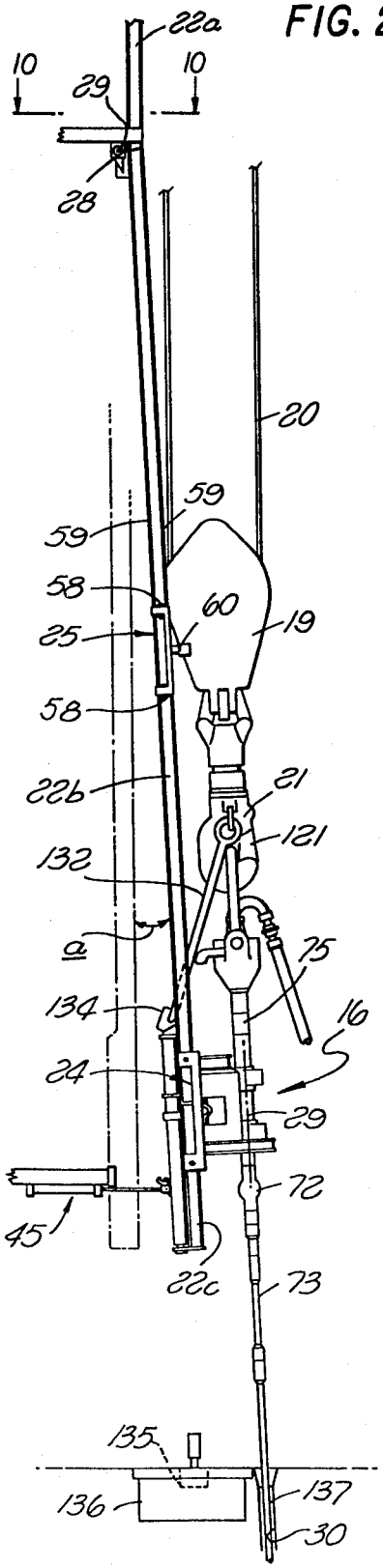
FIG. 2 is a side elevational view taken on line 2—2 of FIG. 1 but showing the drilling unit swung to its mousehole position.
Figure 9:
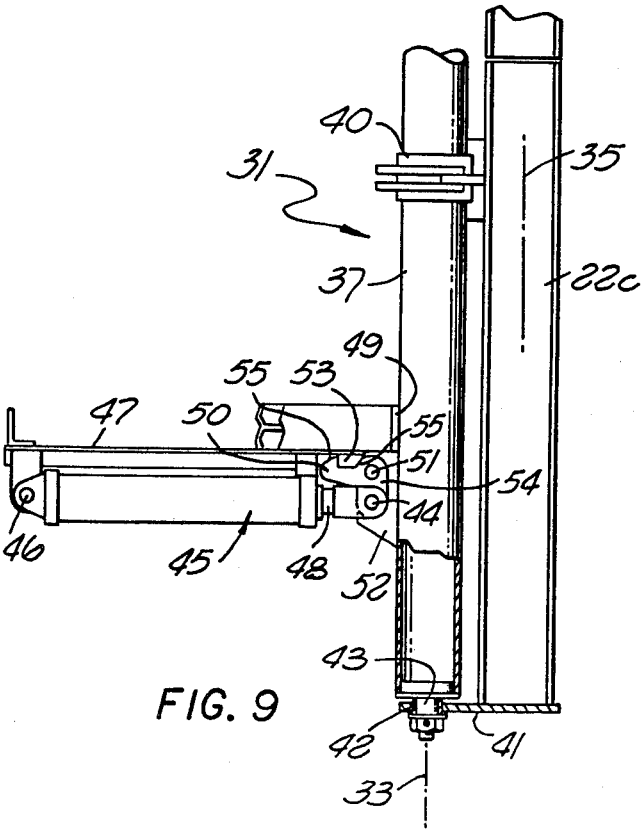
FIG. 9 is an enlarged fragmentary representation of a portion of FIG. 2.

Beneath portions **22*b* and 23*b* of sectionally formed rails 22 and 23, those rails have third lowermost sections 22*c* and 23*c*, which are carried by sections 22*b* and 23*b* respectively for swinging movement therewith between the vertical and inclined positions of FIG. 2, and which also are mounted by connections 31 and 32 (FIGS. 2, 3 and 9) for horizontal swinging movement relative to sections 22*b* and 23*b* respectively about two axes 33 and 34 which are parallel to one another and to the longitudinal axes 35 and 36 of sections 22*b* and 23*b*. This pivotal movement of lower rail sections 22*c* and 23*c* mounts those sections for movement between the full line active positions of FIG. 4 in which they are in longitudinal alignment with and form lower continuations of rail sections 22*b* and 23*b* respectively, and the broken line retracted positions of FIG. 4**.

The two pivotal connections 31 and 32 preferably include two parallel mounting pipes or tubes 37 and 38 centered about axes 33 and 34 and connected rigidly to sections **22*b* and 23*b* at the back thereof, as by welding or by attachment to mounting rings or clamps 39 secured rigidly to sections 22*b* and 23*b* and extending about and attached rigidly to the upper ends of pipes 37 and 38. Near their upper ends, each of the lower sections 22*c* and 23*c* may carry a bearing sleeve 40 which extends about the associated tube 37 and 38 and fits closely thereon to locate the upper portion of the section 22*c* or 23*c* for the desired pivotal motion about axis 33 or 34. At their lower ends, rail sections 22*c* and 23*c* may carry bottom plates 41 projecting inwardly beneath pipes 37 and 38 and having bearings 42 disposed about lower pivot pins 43 projecting downwardly from the two pipes in a relation supporting the weight of the lower sections 22*c* and 23*c* from pipes 37 and 38 while permitting pivotal movement of sections 22*c* and 23*c* about axes 33 and 34. Plate 41 extends horizontally across the bottom of each of the lower rail sections 22*c* and 23*c*, and is welded thereto, and functions as a stop preventing movement of carriage 24** downwardly off of the rails.

The two rail sections **22*b* and 22*c* are adapted to be power actuated between the vertical and inclined positions of FIG. 2 by a piston and cylinder mechanism 45 (FIGS. 2 and 9), whose cylinder is connected at 46 to a horizontally extending stationary portion 47 of the derrick, and whose piston rod 48 acts against the tube 37 of pivotal connection 31. In the vertical position of rail section 22*c*, its associated mounting tube 37 may bear against an arcuately curved stop member 49 acting to effectively locate the swinging rail sections in their vertical condition. A latch element 50 pivoted at 51 to a bracket 52 projecting rearwardly from and welded or otherwise secured to tube 37 is engageable with a coacting latch part 53 fixed stationarily to the derrick and to parts 47 and 49, to positively hold tube 37 and the connected rail parts in their vertical drilling positions. The piston rod 48 of mechanism 45 may be pivotally connected at 44 to a downwardly projecting arm 54 of latch element 50, in a relation pivoting the latch element in a counter clockwise direction and from its holding position to a released position in response to rightward actuation of the piston rod 48. This pivotal movement of latch element 50 is limited by engagement of piston rod 48 with tube 37, so that upon rightward actuation of the piston rod it acts first to release the latch element and then push rail sections 22*b* and 22*c* rightwardly to the full line inclined position of FIG. 2. Upon powered returning or leftward movement of the piston rod, the rod swings the rails back to their broken line positions of FIG. 2 and swings latch element 50 to its holding condition of FIG. 9 to again positively retain the swinging rail parts in vertical drilling positions. Cam surfaces 55 on the latch parts 50 and 53 act to cam element 50 in a counter clockwise direction by engagement with part 53, to enable the latch elements to move past one another into latching condition. The clockwise pivotal movement of element 50 relative to its mounting bracket 52 is appropriately limited by suitable stop shoulders to prevent pivoting of element 50 beyond a proper position for engagement with part 53**.

The second pair of swinging rail sections **23*b* and 23*c* are also adapted to be power actuated between vertical and inclined positions corresponding to those illustrated in FIG. 2, and in unison with sections 22*b* and 22*c*. For this purpose, there is provided in conjunction with sections 23*b* and 23*c*** a second piston and cylinder mechanism 45 and related parts 49, 50 and 53 identical with those discussed above in connection with sections 22*b* and 22*c*. When hydraulic fluid or other pressurized fluid is supplied to the two cylinders 45, they act to swing rail sections 22*b*, 22*c*, 23*b* and 23*c* in unison between their vertical drilling positions and their inclined mousehole positions.

Carriage 25 to which traveling block 19 is connected includes two frames 56 and 57 extending partially about the rails 22 and 23 respectively and rotatably carrying rollers 58 which are received between and engage the front and rear flanges 59 of the various rail sections in a manner effectively locating carriage 25 against movement transversely of the longitudinal axis of the rail structure, and guiding the carriage for movement only longitudinally of the rails. A cross piece 156 may extend between and rigidly interconnect the two roller carrying frames 56 and 57 of the carriage, and be pivotally connected to the traveling block at 60 to locate the traveling block relative to the carriage while permitting slight pivotal movement of the block relative to the carriage.

The drilling unit 16 includes the previously mentioned rail contacting carriage structure 24, a power unit 61 for turning the string, and a conventional swivel 62 for delivering drilling fluid to the string. As best seen in FIGS. 1, 4, 7 and 8, the carriage portion of the drilling unit may include two upper and lower parallel horizontally extending top and bottom frame members 63 and 64 interconnected by two parallel vertical frame members 65 and 66 appropriately welded or otherwise secured rigidly to elements 63 and 64. Spaced parallel vertical plates 67 project rearwardly from member 63 and 64 at their opposite ends (FIG. 4), for reception at opposite sides of the rails, and carry rollers 68 engaging the front and rear flanges of the H-shaped rails, and rollers 69 engaging the rail webs (FIG. 7), to locate the drilling unit relative to the rails and guide the drilling unit for movement only longitudinally of the rails and parallel thereto.

The power unit 61 of the drilling assembly includes a pipe section 70 having a lower tapered external thread 71 forming a pin and threadedly connectable to the upper end of drill string 13 to drive it. In most instances, a conventional crossover sub 72 and a short 'pup joint' 73 are connected into the string directly beneath the power unit. At its upper end, pipe section 70 has a tapered internal thread 74 connectable to the rotary stem 75 of swivel 62. This stem 75 turns with the drill string relative to the body 76 of the swivel, which body is supported in non-rotating relation by a bail 77 engaging hook 21 of the traveling block. Drilling fluid is supplied to the swivel through a flexible inlet hose 78, whose second end is connected to the derrick at an elevated location 79 well above the level of the rig floor 180.

For driving the tubular shaft 70, power unit 61 includes an electric motor 80 having a case or housing 81 containing the field coils of the motor and an armature 82 mounted to rotate relative to the motor housing about an axis 83 parallel to axis 29 of the tubular offset shaft 70. Armature 82 is journaled for rotation within the case by a lower bearing 85, and by an upper double thrust bearing 86 acting to prevent vertical movement of the armature relative to the case and acting to effectively support the weight of the armature from the case in the vertically extending condition of the armature axis. A pinion gear 87 is connected to the lower end of the armature shaft 88 and is engageable with a larger diameter ring gear 89 disposed about shaft 70 and fixed against rotation relative thereto by a key represented at 90. Gear 89 is supported against movement downwardly along shaft 70 by an annular engagement with an upwardly facing support shoulder 91 formed on the shaft. The gears 87 and 89 may be contained within a lower gear case or housing 92 secured by bolts 93 to a horizontal wall 94 attached to and carried by the motor housing 81.

The driven pipe section 70 is journalled for rotation relative to housing 81 of the motor by two axially spaced bearing assemblies 95 and 96 located essentially laterally opposite the upper and lower ends respectively of the armature. Each of the bearing assemblies 95 includes two complementary semi-cylindrical bearing shoes 97 and 98, having complementary semi-circular radially turned flanges 99. The inner shoe 97 of each bearing assembly 95 and 96 is received and located within a cylindrically curving recess 100 formed by the outer surface of a cylindrically curving wall 101 of the motor housing. Diametrically opposite the location of this curving housing wall, there is provided a bearing cap 102, having a recess 103 which curves semi-cylindrically to receive and locate the outer half 98 of the bearing. Cap 102 is secured to the motor housing by bolts 202, to locate and confine the bearings and the shaft 70 journaled therein in the relation illustrated in FIG. 5. Appropriate means are provided for delivering lubricant to the bearings, as for instance from a reservoir represented at 106.

A thrust bearing structure is also provided for supporting the weight of motor 80 and its associated parts, including carriage structure 24, from the shaft 70 which is suspended by the traveling block. This thrust bearing is desirably located as represented at 107 in FIG. 5, vertically between an upper surface 108 of the inner hub portion of gear 89 and the annular flange portion 99 of the lower bearing assembly 96. Flange 99 in turn bears upwardly against a horizontal annular undersurface 109 formed on the motor housing to thereby support that housing. The lower race of thrust bearing 108 turns with gear 89 and shaft 70, while the upper race of the thrust bearing as well as bearing shoes 96 and the motor housing do not rotate.

The power unit 61 may include a brake 110 operable to apply a controlled braking force to the armature of motor 80. This brake may include an annular inflatable bladder 111 adapted when inflated to force an annular braking element 112 against a cylindrical brake drum 113 attached to the armature shaft.

Figure 8:
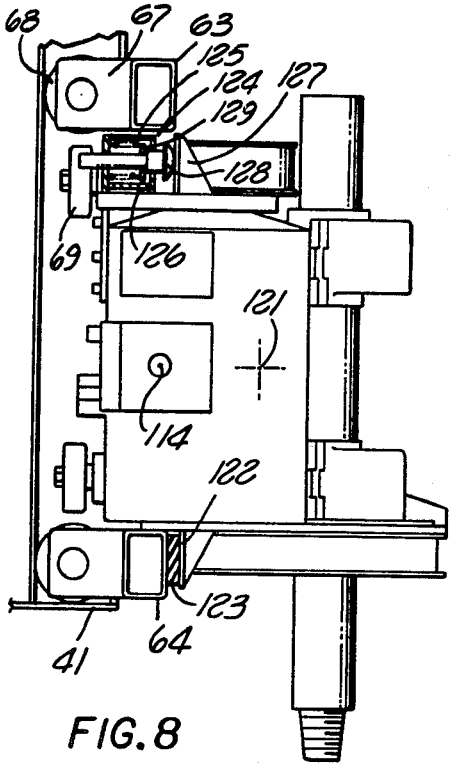
FIG. 8 is a fragmentary vertical section taken on line 8—8 of FIG. 7.
Figure 7:
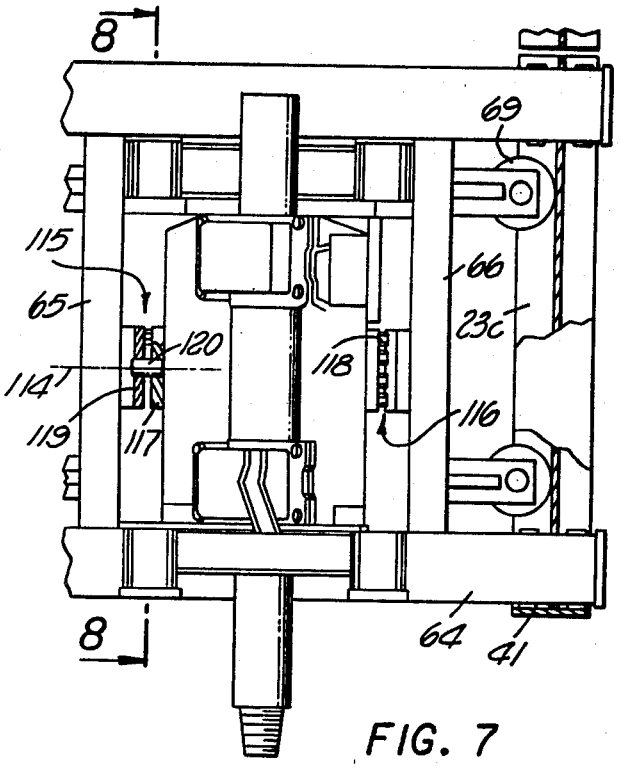
FIG. 7 is a reduced fragmentary front elevational view of the drilling unit taken on line 7—7 of FIG. 5.

It is contemplated that in some installations the housing of motor 80 may be secured rigidly to the framework of carriage 24, to maintain the axis 84 of the driven shaft 70 permanently in a precisely fixed position relative to the framework of the carriage. In most instances, however, it is preferred that the motor housing and its carried parts be mounted for slight pivotal movement relative to the framework 63-64-65-66 of the carriage about a horizontal axis 114 (FIGS. 7 and 8). This limited pivotal movement of the motor may be permitted by two pivotal connections 115 and 116 at opposite sides of the motor, each including a plate 117 secured to the housing of the motor by screws or bolts 118, and a second plate 119 secured rigidly to one of the vertical carriage frame members 65 or 66. Pivot pins 120 are received within registering openings in plates 117 and 119, to form the desired pivotal connections.

Referring now to FIG. 8, it will be noted from that figure that the center of gravity 121 of the motor and all of the parts carried thereby is located to the right of axis 114 in FIG. 8, causing the motor and connected parts to pivot by gravity in a clockwise direction as viewed in FIG. 8, with that movement being limited in the FIG. 8 position by engagement of two plates 122 attached rigidly to the motor housing with a pair of cushioning elements 123 of rubber or other elastomeric material. These cushioning parts may be secured to the front vertical surface of lower frame member 64 of the carriage. In the position of FIG. 8 in which cushioning parts 123 limit the clockwise pivotal movement of the motor and attached elements, the axis 29 of motor driven pipe section 70 is directly parallel to the longitudinal axes of the rail sections on which carriage 24 is located. If the carriage is in engagement with a directly vertical portion of the track structure, the axis 29 of driven shaft 70 of the drilling unit is directly aligned with the vertical axis of the well (when elements 122 are in engagement with elastomeric stop cushions 123).

Pivotal movement of the motor housing and its connected parts in a counter clockwise direction about axis 114 as viewed in FIG. 8 is resisted and limited by two spring assemblies 124, each of which includes a coil spring 125 contained within a housing 126 secured to one of the vertical frame elements 65 or 66 of carriage 24. Two upwardly projecting lugs 127 secured to the motor housing are engageable with pins 128 to actuate those pins leftwardly upon counter clockwise pivotal movement of the motor about axis 114, with the springs 125 acting through washers 129 to resist the leftward movement of the pins and thus yieldingly urge the motor to its FIG. 8 position in which the axis of the driven shaft is directly parallel to the track axes.

The motor 80 is preferably air cooled, by circulation of air from a flexible supply hose 130 (FIG. 1) through the interior of the motor housing. Hose 130 receives air from a high capacity blower 131 connected to derrick 11 at a location spaced a substantial distance above the rig floor 80. By virtue of this placement of the blower and its inlet opening at such an elevated location, air is drawn into the blower at a location well above the rig floor level at which combustible vapors may be present, and thus the air delivered to the motor for cooling purposes is not inflammable and can not be ignited by the motor. For this safety purpose, it is presently preferred that the blower be located at approximately the location at which the hose leading to the swivel is connected to the derrick, desirably at least about eighty feet above the rig floor.

To now describe the operation of the drilling apparatus of FIGS. 1 through 10, the apparatus during actual drilling is in the condition illustrated in FIG. 1, with all of the three sections 22*a*, 22*b* and 22*c* of guide rail 22 extending directly vertically and in alignment with one another and with the three sections of guide rail structure 23 also disposed vertically and in alignment with one another. This condition of the guide rail is illustrated in broken lines in FIG. 2. With the guide rails in that directly vertical condition, the drilling unit 16 and its carriage 24 as well as the traveling block 19 and its carriage 25 are all effectively guided for only vertical movement along axis 15 of the well, with the driven shaft 70 of the drilling unit in alignment with that axis. Shaft 70 is connected to the upper end of the drill string and by rotation of the motor armature is turned to correspondingly turn the drill string and perform a drilling operation. During that drilling operation, a pair of links 132 may be suspended by the side portions 133 of hook 21, but be deflected by the swivel to an inactive position between the rails as represented in FIG. 2. An elevator 134 may be suspended by the lower ends of these links 132 for use in hoisting the drill pipe when the drilling unit is in its inactive position.

As the drilling progresses, the drilling unit and string gradually move downwardly, ultimately to the full line position of FIG. 1, beyond which further downward movement of carriage 24 and the drilling unit is prevented by engagement of the lower rollers 68 of the drilling unit with the bottom stop plates 41 of the rails (see FIGS. 7 and 8). With the drilling unit in this position, slips are placed in a master bushing assembly 135 in the rig floor (or in a rotary table 136 located in the rig floor) and about the upper section of the drill string, to support the string independently of the drilling unit, following which the pup joint 73 is rotated by motor 80 to detach the pup joint from the remainder of the string. The draw works is then actuated to raise the traveling block and connected parts upwardly a short distance, as for instance to about the level illustrated in FIG. 2, and the piston and cylinder mechanisms 45 are then actuated to swing the lower sections 22*b*, 22*c*, 23*b* and 23*c* of the rails rightwardly to the full line inclined positions of FIG. 2 in which shaft 70 of the drilling unit and pup joint 73 are aligned with a length of pipe 137 in mousehole 30. The traveling block and connected parts are lowered sufficiently to bring the pup joint 73 into engagement with the stand in the mousehole, and the motor of the drilling unit is then turned in a make-up direction to connect the pup joint to the stand in the mousehole. The connection may be completed by tongs or other equipment, and the traveling block is then actuated to lift the drilling unit and connected stand upwardly along the inclined tracks 22*b*, 22*c*, 23*b* and 23*c*. In some instances the length of the stand within the mousehole will be greater than the combined length of the lower two sections of each track assembly. For example, the height of pivotal connections 28 may be sixty feet above the rig floor, while the length of a triple stand in the mousehole may be ninety feet. Consequently, when the drilling unit reaches the location of the upper ends of the inclined portions of the tracks, there may still be a portion of the stand contained within the mousehole. As the drilling unit and its carriage move upwardly beyond the location of the pivotal connections 28, they move onto and are directed exactly vertically along the upper fixed portions 22*a* and 23*a* of the sectionally formed rail assemblies. Since the stand being moved from the mousehole is still at a slight angle of inclination at this time, the entire motor 80 pivots slightly in a counterclockwise direction as viewed in FIGS. 2 and 8 relative to the directly vertically extending carriage 24, and as permitted by the pivotal connections 115 and 116 represented in FIG. 7. This pivotal movement of the motor and driven shaft 70 about axis 114 relative to carriage 24 is resisted by spring units 124 of FIG. 8, and as a result the motor pivots only the amount necessary for effective removal of the stand from the mousehole. When the stand is completely withdrawn from the mousehole, springs 125 and the weight of the stand return the motor and stand to a directly vertically extending condition of alignment with the well axis, for connection to the upper end of the string by rotation of the motor and tightening tongs, after which the slips which had been suspending the drill string from the rig floor may be removed and the drilling operation may be continued. At an appropriate time during withdrawal of the stand from the mousehole, as for instance after the carriages of both the drilling unit and traveling block have reached positions of engagement with the upper stationary portions 22a and 23a of the rails, power cylinders 45 may be actuated to return the inclined portions of the tracks from their full line position of FIG. 2 to their broken line drilling position of that figure, to be latched in those vertical positions by latching parts 50 and 53 as previously discussed.

If it becomes desirable to move a length of pipe from the upper end of the string to the mousehole, this can be accomplished by a reversal of the above discussed procedure, that is, by first using tongs or other equipment to break the connection between an upper section of the drill pipe and the remainder of the string, then actuating motor 80 to spin the upper section out of the string, then swinging the rails to the inclined full line position of FIG. 2 to move the detached section into alignment with the mousehole, and then lowering the section into the mousehole and energizing motor 80 to unscrew the drilling unit from that section.

When it is desired to remove the string of pipe or a portion thereof from the well, and/or to lower a portion or all of the string of pipe back into the well, the present apparatus permits performance of that function by conventional tripping equipment without interference by the drilling unit and related equipment of the invention. To convert the apparatus to this tripping mode, the carriages 24 and 25 are first pulled upwardly by the draw works and traveling block, with the rail sections all in their directly vertical drilling condition, to positions in which the lower carriage 24 is just above the lowermost rail sections 22c and 23c. With both of the carriages thus out of engagement with the lower rail sections, section 22c is swung pivotally about its axis 33 from the active full line position of FIG. 4 to the retracted inactive broken line position of that figure. The traveling block and connected parts may then be lowered to move carriage 24 downwardly into engagement with rail section 23c, but not in engagement with rail section 22c by virtue of the discussed positioning of section 22c in its inactive condition. When all of the rollers of carriage 24 are properly in engagement with bottom rail section 23c, and the carriage is supported on the bottom wall 41 of that rail section, gate 121 of hook 21 is opened, and the entire drilling unit and swivel assembly and the connected rail section 23c are swung pivotally about vertical axis 34 from the full line postion of FIG. 4 to the broken line position of that figure. During such movement, the bail 77 of the swivel moves out of its position of connection with hook 21. In the retracted broken line position of FIG. 4, the entire drilling assembly and all of its connected parts are well away from the vertical axis 15 of the well, and offer no obstruction to hoisting and lowering of the drill string by the traveling block and hook 21. As the swivel moves away from the hook, links 132 and elevator 134 swing downwardly to vertical positions as represented in FIG. 3, in which the elevator may be brought into contact with a section of the drill string, to hoist it upwardly to a position in which a next successive section can be supported in the slips and the upper section can be detached from the string in conventional manner. The entire string may be removed sectionally from the well in this way, and then placed back into the well by a reverse operation, to complete a round trip of the string in minimum time without interference by the drilling unit and without causing wear on the motor or other parts of the drilling unit such as would occur if the drilling unit itself were utilized to trip the pipe.

After completion of the round trip, the drilling unit including the motor, swivel, etc. can be swung back to the full line position of FIG. 4 (with track section 22c still in its inactive position) the bail of the swivel can be connected to hook 21, and the traveling block can be utilized to raise both carriages upwardly far enough to permit bottom rail section 22c to be swung back to its active position thus placing the entire apparatus in its original drilling condition.

Figures 5, 6, 11:
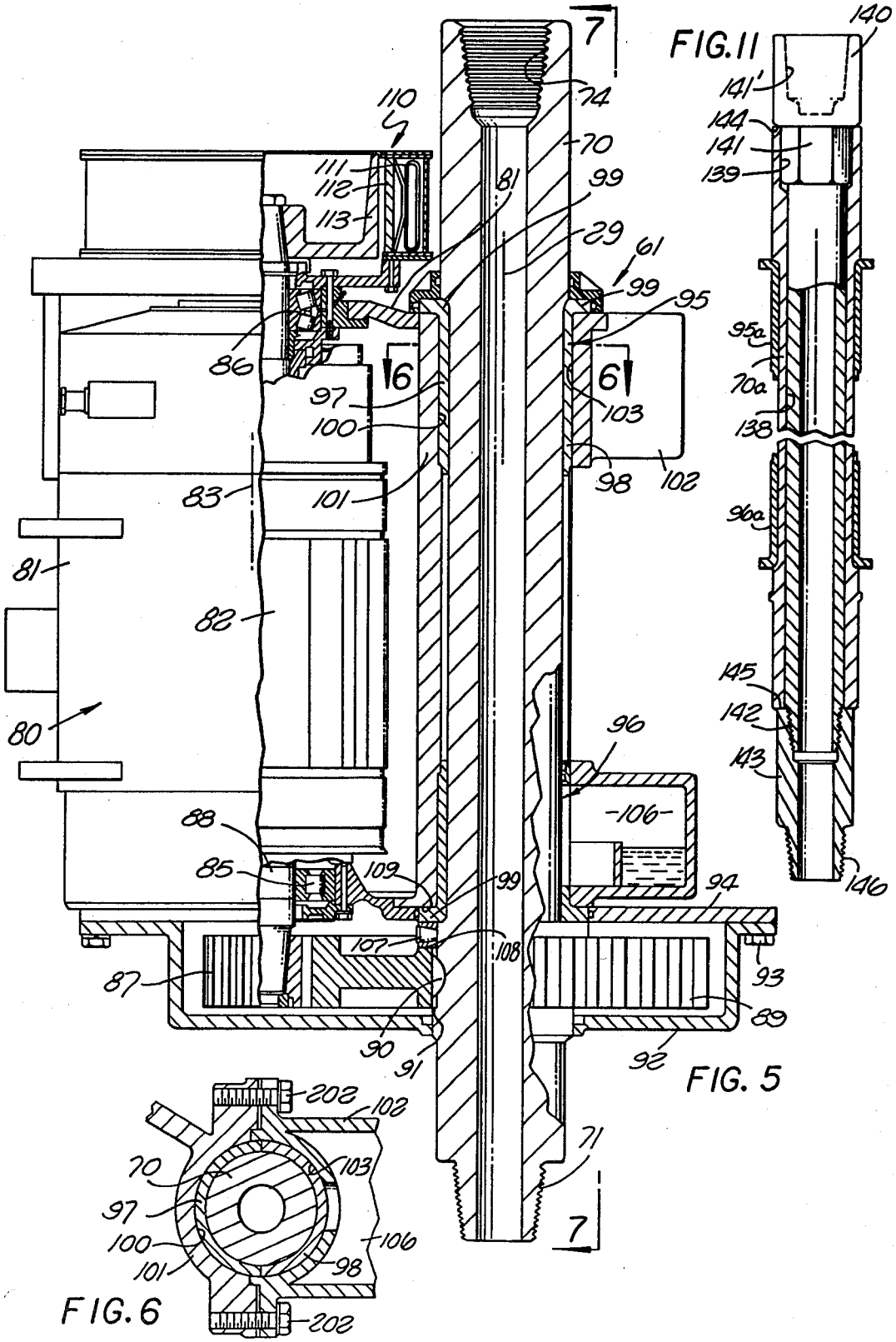
FIG. 5 is an enlarged fragmentary vertical section taken on line 5—5 of FIG. 1.
FIG. 6 is a fragmentary horizontal section taken on line 6—6 of FIG. 5.
FIG. 11 is a view corresponding to a portion of FIG. 5 but showing a variational quick disconnect type of shaft assembly for the drilling unit.

FIG. 11 illustrates fragmentarily a quick disconnect shaft arrangement which may be utilized in lieu of the integral one piece shaft 70 of FIG. 5. In FIG. 11, the two main motor bearings 95a and 96a may be identical with bearings 95 and 96 of FIG. 5, and may have the same relationship to the rest of the motor, gears, etc. as illustrated in FIG. 5. Instead of the unitary one piece driven shaft 70 of FIG. 5, the FIG. 10 arrangement includes a tubular part 70a, having a straight cylindrical inner surface 138 and an upper internally non-circular and preferably hexagonal recess 139. A tubular part 140 is removably receivable within element 70a, and has an externally non-circular portion 141 engaging non-circular recess 139 in driving relation. The second part 140 has an upper tapered internal thread 141' and a lower tapered externally threaded pin portion 142, with this pin portion being threadedly engageable with a short attaching tube or pipe 143 in the illustrated relation to clamp part 70a between shoulders 144 and 145 on parts 140 and 143 to integrate the parts 70a, 140 and 143 into a unitary structure driven rotatably by the motor. The lower threads 146 of part 143 are then connectable to the drill string in the same manner as the lower threads of part 70 of the first form of the invention, to drive the string rotatively. Gear 89 drives part 70a in the same manner discussed in connection with gear 89 and part 70 of the first form of the invention.

If it becomes desirable to remove and replace the threaded portions of the shaft assembly of FIG. 11, this may be done quickly and easily by merely breaking the threaded connection at 142 between parts 140 and 143, and then withdrawing the part 140 upwardly from within pipe 70a. Replacement parts may then be connected to tube 70a to return the apparatus to operative condition without removal of the main driven shaft part 70a of the motor assembly.

While certain specific embodiments of the present invention have been disclosed as typical, the invention is of course not limited to these particular forms, but rather is applicable broadly to all such variations as fall with in the scope of the appended claims.

I claim:

1. Well drilling apparatus comprising:

a drilling unit including an element adapted to be connected to the upper end of a drill string for rotation therewith about the axis of the string, and a motor operable to drive said element and the connected string rotatively about said axis;

an elongated guide structure which extends generally vertically parallel to said axis and which guides the drilling unit, in a predetemined active position thereof in which the unit is aligned with said axis, for movement upwardly and downwardly relative to and along said guide structure and along said axis to drill a well;

a traveling block which is suspended above the drilling unit and is power actuable upwardly and downwardly along said axis;

a connector carried by said traveling block and detachably connectable to said drilling unit in a relation suspending the drilling unit from the traveling block in said active position of the drilling unit for movement upwardly and downwardly with the traveling block along said axis to drill a well;

an upper first carriage engaging said guide structure and guided thereby for movement relative to the guide structure parallel to said axis and which is connected to said traveling block to locate it in alignment with said axis as the traveling block moves upwardly and downwardly;

a lower second carriage engaging said guide structure at a location beneath said upper carriage and guided by said guide structure for movement relative thereto along said axis and connected to said drilling unit to locate it in alignment with said axis and said traveling block as the two carriages and said traveling block and said drilling unit all move upwardly and downwardly together to drill a well; and means mounting said drilling unit including said element and said motor thereof for movement laterally relative to said upper carriage and said traveling block between said active position in which the drilling unit is aligned with said axis and suspended from the traveling block for vertical movement therewith and an inactive position in which the drilling unit is detached from said connector and traveling block and is offset to a side of the axis, while the traveling block is retained by said upper carriage and guide structure in alignment with said axis to suspend a drill string independently of the drilling unit for movement upwardly and downwardly with the traveling block along said guide structure and relative to the laterally offset drilling unit.

2. Well drilling apparatus as recited in claim 1, in which said mounting means include hinge means mounting said drilling unit including said element and said motor thereof for swinging movement about an essentially vertical axis offset laterally from said first mentioned axis between said active and inactive positions.

3. Well drilling apparatus as recited in claim 2, in which said connector is a hook carried at the underside of said traveling block, said drilling unit having a bail at its upper end detachably connectible to said hook.

4. Well drilling apparatus as recited in claim 3, in which said guide structure includes two elongated parallel guide rails, and each of said carriages has rollers engaging both of said rails and guided thereby for movement upwardly and downwardly along the guide structure.

5. Well drilling apparatus as recited in claim 4, in which said guide structure includes two elongated parallel guide rails, and each of said carriages has rollers engaging both of said rails and guided thereby for movement upwardly and downwardly along the guide structure.

6. Well drilling apparatus as recited in claim 1, in which said connector is a hook carried at the underside of said traveling block.

7. Well drilling apparatus as recited in claim 1, in which said mouting means include means mounting said lower carriage for lateral movement with the drilling unit relative to said upper carriage and traveling block between said active and inactive positions of the drilling unit.

8. Well drilling apparatus as recited in claim 1, in which said guide structure has an upper portion and a lower portion, said lower carriage being movable vertically between a position in which it engages the upper portion of said guide structure and is guided thereby for vertical movement and a position in which it engages the lower portion of the guide structure and is guided thereby for vertical movement, said mounting means including means mounting at least part of said lower portion of the guide structure for movement laterally relative to said upper portion of the guide structure with said drilling unit to move the latter between said active and inactive positions.

9. Well drilling apparatus as recited in claim 1, in which said mounting means include means mounting a first portion of said guide structure for movement relative to a second portion thereof carrying the drilling unit and between said active and inactive positions of the drilling unit.

* * * * *